United States Patent [19]

Berman

[11] Patent Number: 4,699,536

[45] Date of Patent: Oct. 13, 1987

[54] PEN AND PENHOLDER COMBINATION

[76] Inventor: James Berman, 160 E. 93rd St., New York, N.Y. 10028

[21] Appl. No.: 867,968

[22] Filed: May 29, 1986

[51] Int. Cl.[4] ..... A45D 40/20

[52] U.S. Cl. ..... 401/88; 401/195

[58] Field of Search ..... 401/195, 88; 211/69.5, 211/69.1; 15/435; 24/128, 700, 588, 90 B, 90 R; 403/353

[56] References Cited

U.S. PATENT DOCUMENTS

| | | | |
|---|---|---|---|
| 964,352 | 7/1910 | Wheeler | 24/128 R |
| 1,462,108 | 7/1923 | Holywell | 211/69.5 |
| 1,511,167 | 10/1924 | Jesnig | 211/69.1 |
| 1,716,065 | 6/1929 | Kiamie | 24/90 B |
| 1,851,730 | 3/1932 | Rutherford | 24/700 |
| 2,853,054 | 9/1958 | Rosa | 211/69.5 |
| 3,570,284 | 3/1971 | Hendricks | 401/195 |
| 4,521,970 | 6/1985 | Jester | 24/90 R |

FOREIGN PATENT DOCUMENTS

| | | | |
|---|---|---|---|
| 650272 | 10/1962 | Canada | 211/69.1 |
| 85200 | 8/1921 | Fed. Rep. of Germany | 211/69.5 |
| 13324 | of 1910 | United Kingdom | 24/700 |

*Primary Examiner*—Richard J. Scanlan, Jr.
*Assistant Examiner*—Anthony Knight
*Attorney, Agent, or Firm*—McAulay, Fields, Fisher, Goldstein & Nissen

[57] ABSTRACT

A pen and penholder combination includes a pen portion. An elongated flexible tether attaches on one end to the pen and on another end to a stop. A disk with a hole formed therein is slidingly received on the tether. The penholder is permanently securable to a writing surface. The penholder has a penholder surface with an upper and lower face. A disk securing slot is formed in the penholder surface. The slot is shaped and dimensioned to receive the stop therethrough and to receive the disk therethrough when the disk is oriented substantially perpendicular to the penholder surface. After the disk is passed through the slot and when it is not oriented substantially perpendicular to the penholder surface it abutts against the bottom face of the surface and cannot be passed through the slot.

7 Claims, 5 Drawing Figures

PEN AND PENHOLDER COMBINATION

BACKGROUND OF THE INVENTION

The present invention relates to a pen and penholder.

Banks and other institutions where forms are frequently filled-out by customers generally provide pens for the customers to use. Since unsecured pens are taken and/or lost, and since a neater appearance is obtained by keeping pens in penholders, these institutions generally use a pen and penholder in combination with the penholder being permanently attached to a desk or other writing surface.

Despite the above-described arrangement pens are frequently removed from the banks. Since the pens are generally connected to the holder by a tether or cable, the person who desires to remove the pen merely cuts the tether and takes the pen leaving behind the holder. To replace a new pen into the secured base is expensive and time consuming since it generally requires special tools for working with the gromet used in standard pen and penholder combinations. The cost of the labor to make the replacement greatly exceeds the cost of the pen.

Accordingly, it is an object of this invention to provide a pen and penholder combination which allows quick, easy, and relatively inexpensive re-attaching of pens to the holders.

It is a further object of this invention to provide such a combination which permits pens to be attached to the holder without the use of special tools.

BRIEF DESCRIPTION

In one embodiment of the present invention a specially developed pen and penholder is provided. The pen or other writing implement (as used herein pen will mean any pen or other appropriate writing implement) is connected to one end of an elongated flexible tether. The other end of the tether is received through a hole formed in a disk. A stop is attached to the other end of the tether to prevent the disk from sliding off of that end of the tether. A penholder which can be permanently secured to a writing surface is provided. The penholder has a penholder surface with upper and lower faces. A slot is formed in the penholder surface. The slot is shaped and dimensioned to receive the stop means therethrough and further to receive the disk therethrough when the disk is oriented substantially perpendicular to the plane of the penholder surface.

After the disk is passed through the slot in the penholder surface, it tends not to be oriented perpendicular to the penholder surface and then it abuts against the lower face of the penholder surface so that it cannot be passed through the slot.

The pen and penholder combination permit easy replacement of pens in penholders.

BRIEF DESCRIPTION OF THE PREFERRED EMBODIMENTS

Figure 1:
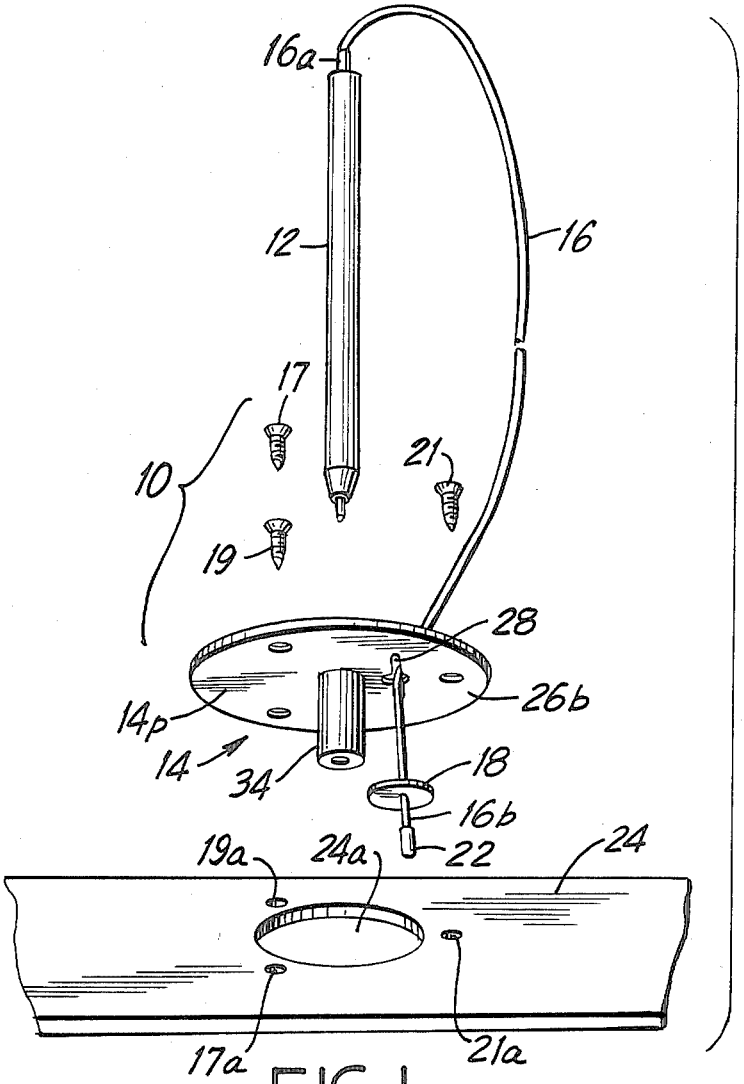
FIG. 1 is an exploded perspective view of one embodiment of the pen and penholder of the present invention showing the penholder before it is attached to the surface.

Referring now to the drawings and more particularly FIG. 1, the reference numeral 10 denotes the pen and penholder combination of the present invention. Combination 10 includes a pen 12 and a penholder 14. An elongated flexible tether 16 is provided which is connected at a first end 16*a* to the pen 12.

A small disk 18 is formed with a hole 20 therein. Hole 20 is sized and shaped to slidingly receive the tether 16 therethrough. A stop 22 is attached to a second end 16*b* of the tether to prevent disk 18 from sliding thereoff. The diameter of hole 20 is greater than the cross-sectional diameter of the flexible tether 16 and smaller than the cross-sectional diameter of the stop 22.

Penholder 14 is adapted to be permanently secured to a writing surface 24. The penholder includes penholder surface 26 with an upper face 26*a* and a lower face 26*b*. Penholder surface 26 is formed with a disk securing slot 28 therethrough.

Penholder 14 is attached to writing surface 24 in a manner such as to provide a receptical space 30 below the penholder 14.

In the embodiment shown in FIGS. 1–4, penholder 14 includes a thin, circular, metal mounting plate 14*p*. A circular cut-out 24*a* is formed in the writing surface 24. Cut-out 24*a* has a diameter slightly smaller than the diameter of the metal plate 14*p*. The penholder 14 is connected to the writing surface 24 using three screws 17, 19 21, which are received into three holes 17*a*, 19*a*, and 21*a* which are spaced apart about the perimeter of cut-out 24*a*.

Figure 2:
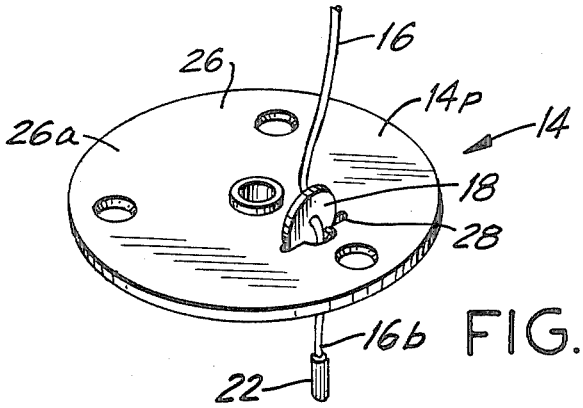
FIG. 2 is a perspective view showing the FIG. 1 pen and penholder showing the tether and disk being slipped through the penholder slot.

Disk securing slot 28 is formed with an elongated portion 28*a* and a circular portion 28*b*. Circular portion 28*b* is centrally positioned in elongated portion 28*a*. The circular portion 28*b* is shaped in dimension to receive stop 22 therethrough. The elongated portion 28*a* is shaped and dimensional such that disk 18, as shown in FIG. 2, can be passed therethrough when disk 18 is oriented substantially perpendicular to penholder surface 26.

Figure 3:
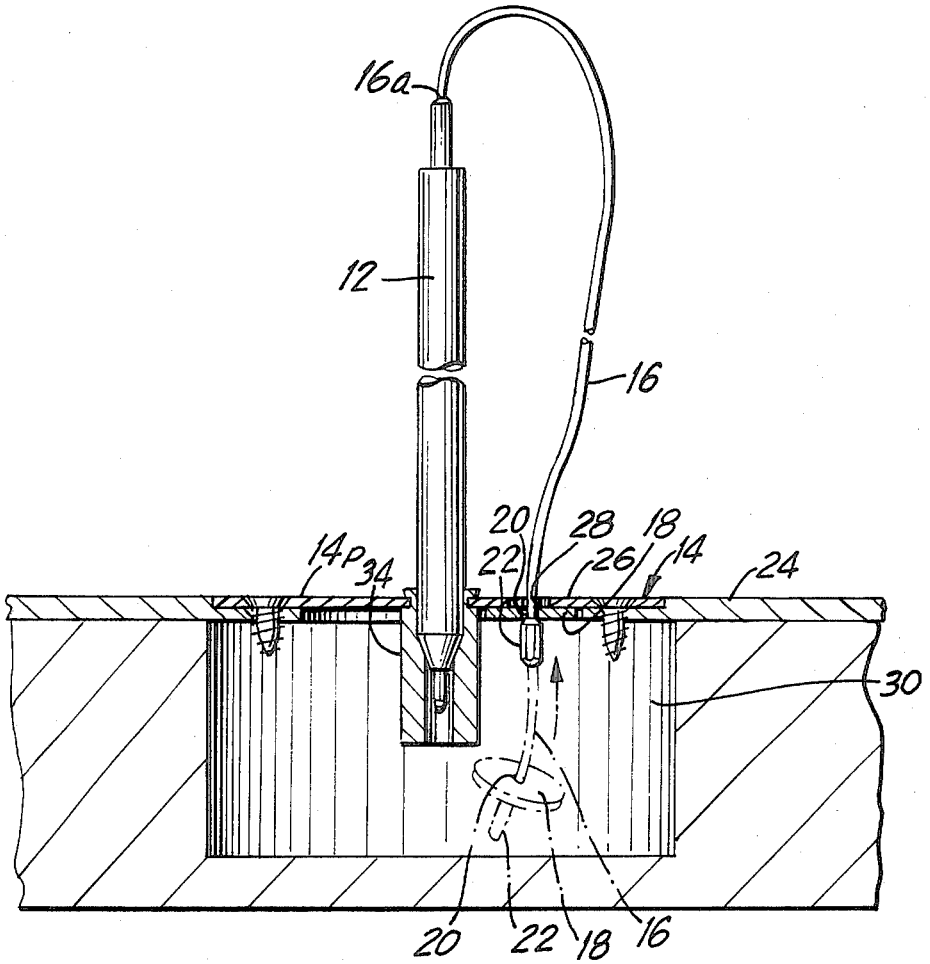
FIG. 3 is a sectional view of the FIG. 1 embodiment showing the pen in the holder and the disk after it is inserted through the slot.
Figure 4:
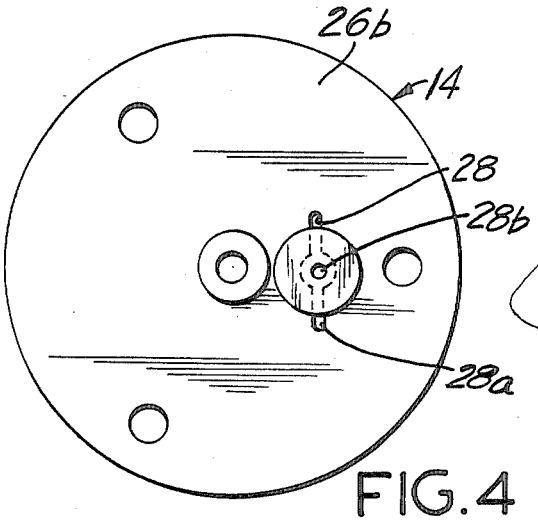
FIG. 4 is a bottom plan view of the lower face of the penholder showing the disk abutting thereagainst.

As shown in FIGS. 3 and 4, after disk 18 is passed through slot 28, and when disk 18 is not oriented substantially perpendicular to the penholder surface it will abut against the lower face 26*b* of the penholder surface. In this position, disk 18 cannot be re-passed through the slot.

A pen retaining portion 34 of the penholder 14 is provided to removably hold the pen 12 therein.

Figure 5:
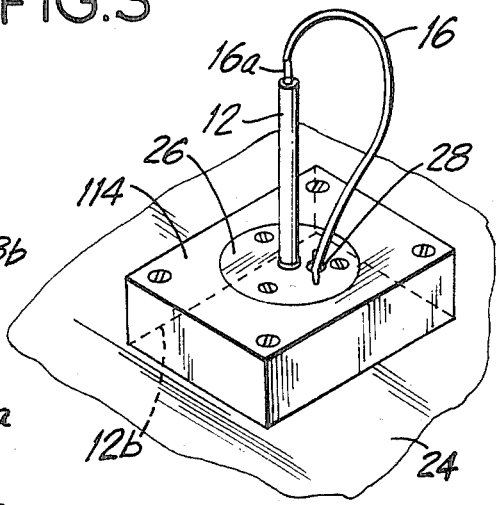
FIG. 5 is a perspective view of another embodiment of the pen and penholder combination.

In the embodiment of the invention shown in FIG. 5, the penholder 114 includes a second penholder surface (not shown) which is substantially parallel to penholder surface/126. The second penholder surface is spaced from and below penholder surface/126. The second penholder surface has an upper face and a lower face and it is connected to the writing surface 24 by means of the lower face. The receptical space (not shown) lies beneath the first penholder surface/126 and above second penholder surface. The two penholder surfaces are connected on all sides forming a closed box such that no access to the inside of the penholder is obtainable.

It is contemplated that the pen and penholder combination 10 of the present invention will be used in the following manner. The penholder will be attached to an appropriate surface. The pen, tether, disk and stop will be assembled. This assembly will then be connected to the holder by passing stop 22 through the circular portion 28*b* of the slot 28 and then by passing disk 18 through the elongated portion 28*a* of the slot. The flexible and elongated nature of the tether 16 in combination with the sliding fit of the disk thereon allow these manuevers to be easily accomplished. After disk 18 is passed through the slot, the tether is pulled upwardly to orient the disk substantially non-perpendicular to the penholder surface and to cause the disk to abutt against the lower face of the surface 26. If a person then cuts the tether 18 to remove the pen, the disk, stop, and a portion of the tether will fall into the recepticle space 30 and a new pen, tether, disk and stop assembly can be easily replaced in the holder by the manner heretofore described.

What is claimed:

1. A pen and penholder combination comprising:

a pen;

an elongated flexible tether, said pen attached to a first end of said tether;

a disk formed with a hole therein, said hole sized and shaped to slidingly receive said tether therethrough;

stop means attached to a second end of said tether for preventing said disk from sliding off said second end of said tether; and a penholder adapted to be permanently secured to a writing surface, said penholder including a penholder surface with an upper face and a lower face, said penholder surface being formed with a disk securing slot therethrough;

said disk securing slot being shaped and dimensioned such that (a) said stop means may be passed therethrough and (b) said disk may be passed therethrough when said disk is oriented substantially perpendicular to the plane of the penholder surface;

said disk after being passed through said slot and when not oriented substantially perpendicular to said penholder surface abutting against said lower face of said penholder surface such that said disk cannot be passed through said slot.

2. The combination of claim 1 and further including means for removably retaining a pen said means being connected to said penholder.

3. The combination of claim 1 wherein said penholder is adapted to be inset into said writing surface such that the penholder surface and the writing surface lies in substantially the same plane.

4. The combination of claim 1 wherein said penholder includes a second surface connected to said penholder surface, said second surface being substantially parallel to said penholder surface and being spaced from and below said penholder surface, said second surface having an upper face and a lower face, said lower face of said second surface being connectable to said writing surface.

5. The combination of claim 1 wherein said disk securing slot has an elongated portion and a circular portion, said disk fitting through said elongated portion, said stop fitting through said circular portion.

6. The combination of claim 5 wherein said circular portion is positioned centrally in said elongated portion.

7. A pen for use with a penholder secured to a writing surface, the penholder of the type including a penholder surface formed with a securing slot therethrough, said pen comprising:

a pen part;

an elongated tether connected at one end to said pen part;

a disk capable of slidingly receiving said tether, said disk being shaped and dimensioned to fit through a securing slot of a penholder when said disk is oriented substantially perpendicular to a penholder surface, said disk being shaped and dimensioned to abut against said penholder surface when not oriented substantially perpendicular thereto such that it cannot fit through said slot; and a stop connected to the other end of said tether to prevent said disk from sliding off said other end of said tether said stop shaped and dimensioned to fit through said securing slot.

* * * * *